US005601409A

United States Patent [19]

Huang

[11] Patent Number: 5,601,409

[45] Date of Patent: Feb. 11, 1997

[54] FAN BLADE FOR CEILING FANS

[76] Inventor: Yung C. Huang, 4, 3F, No. 36, Shu-Hsin Rd., Shu-Lin Town, Taipei Hsien, Taiwan

[21] Appl. No.: 587,021

[22] Filed: Jan. 16, 1996

[51] Int. Cl.[6] ..... F04D 29/34

[52] U.S. Cl. ..... 416/229 R; 416/5; 416/230

[58] Field of Search ..... 416/5, 204 R, 416/213 A, 214 R, 224, 229 R, 230; D23/377, 379, 385, 413

[56] References Cited

U.S. PATENT DOCUMENTS

| | | | |
|---|---|---|---|
| 925,030 | 6/1909 | Russel | 416/5 |
| 925,031 | 6/1909 | Russel | 416/5 |
| 4,653,985 | 3/1987 | Rotherham | 416/229 R |
| 5,110,261 | 5/1992 | Junkin | 416/5 |
| 5,338,156 | 8/1994 | Chien | 416/5 |

*Primary Examiner*—Edward K. Look
*Assistant Examiner*—Christopher Verdier
*Attorney, Agent, or Firm*—Browdy and Neimark

[57] ABSTRACT

A fan blade which includes an open frame, and a flat, thin blade body fastened to the open frame, the open frame having a blade mounting groove on the inside for mounting the blade body, and a coupling head at one end for coupling to a motor shaft, the coupling head being formed of two separated coupling portions detachably connected together by a tongue-and-groove joint so that the two separated coupling portions can be separated from each other for permitting the blade body to be fitted into the blade mounting groove.

13 Claims, 10 Drawing Sheets

FAN BLADE FOR CEILING FANS

BACKGROUND OF THE INVENTION

The present invention relates to fan blades, and relates more particularly to a built-up fan blade which is comprised of an open frame, and a blade body fastened to the open frame.

The blades of regular ceiling fans are commonly unitary elements, having a certain thickness. If the thickness of the blades of a ceiling fan are reduced, the blades tend to deform. However, increasing the thickness of the blades of a ceiling fan will increase their weight and the consumption of material. If heavy blades are installed, the fan motor will consume much power to achieve the desired revolving speed. Furthermore, if a user touches the blades carelessly during the operation of the ceiling fan, the user will be severely injured by the edges of the blades.

SUMMARY OF THE INVENTION

The present invention has been accomplished to provide a fan blade which eliminates the aforesaid drawbacks. It is one object of the present invention to provide a fan blade which has a thin thickness. It is another object of the present invention to provide a fan blade which needs less material to manufacture. It is still another object of the present invention to provide a fan blade which is light. It is still another object of the present invention to provide a fan blade which is protected by a frame. It is still another object of the present invention to provide a fan blade which is a built-up design that can be conveniently dismantled for washing. According to one embodiment of the present invention, the fan blade is comprised of an open frame, and a flat, thin blade body fastened to the open frame, wherein the open frame comprises a blade mounting groove on the inside for mounting the blade body, and a coupling head at one end for coupling to a motor shaft, the coupling head being formed of two separated coupling portions detachably connected together by a tongue-and-groove joint so that the two separated coupling portions can be separated from each other for permitting the blade body to be fitted into the blade mounting groove. According to another embodiment of the present invention, the fan blade is comprised of an open frame, and a thin, flat blade body fastened to the open frame, wherein the blade body has a plurality of pin holes spaced around the border; the open frame comprises a plurality of upright pins at one side respectively fitted into the pin holes of the blade body and then fastened with a respective cap.

DETAILED DESCRIPTION OF THE PREFERRED EMBODIMENTS

Figure 1:
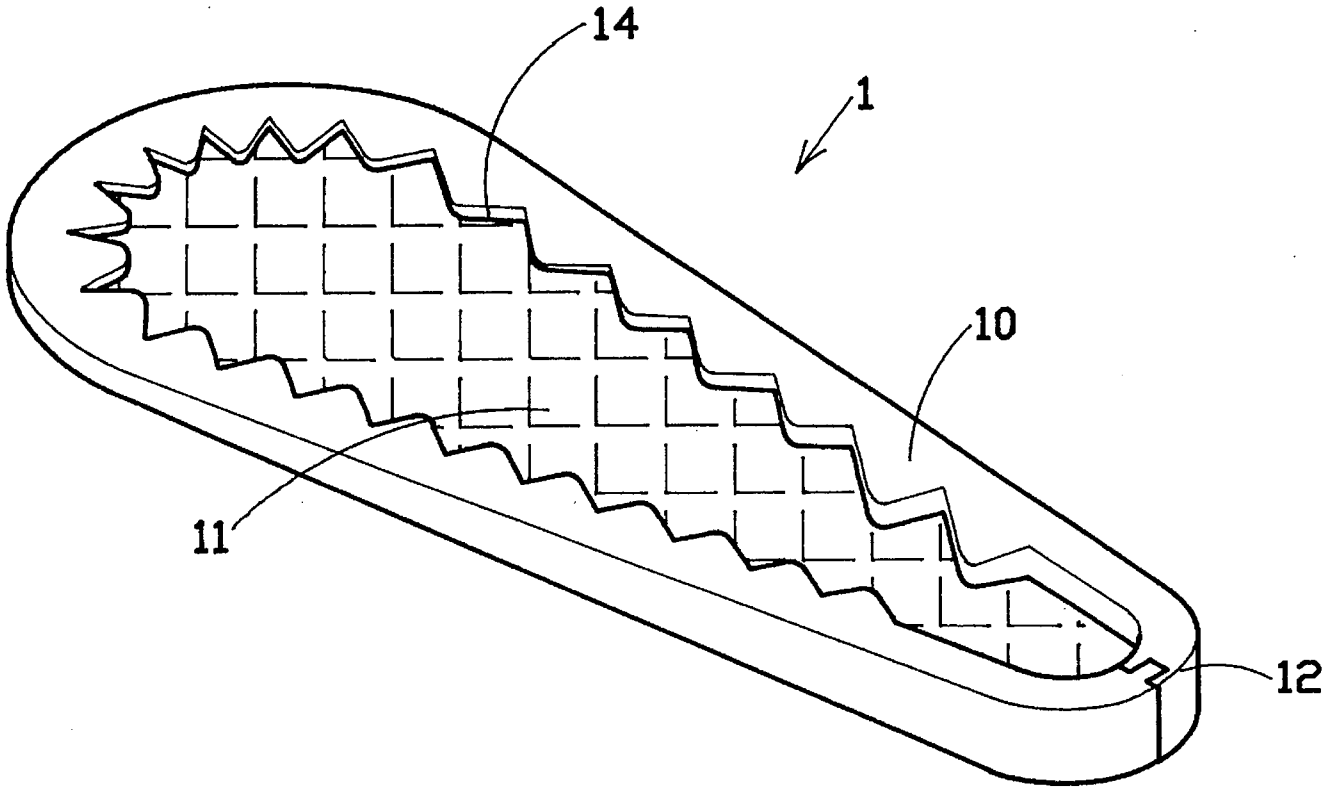
FIG. 1 is an elevational view of a fan blade according to a first embodiment of the present invention.
Figure 2:
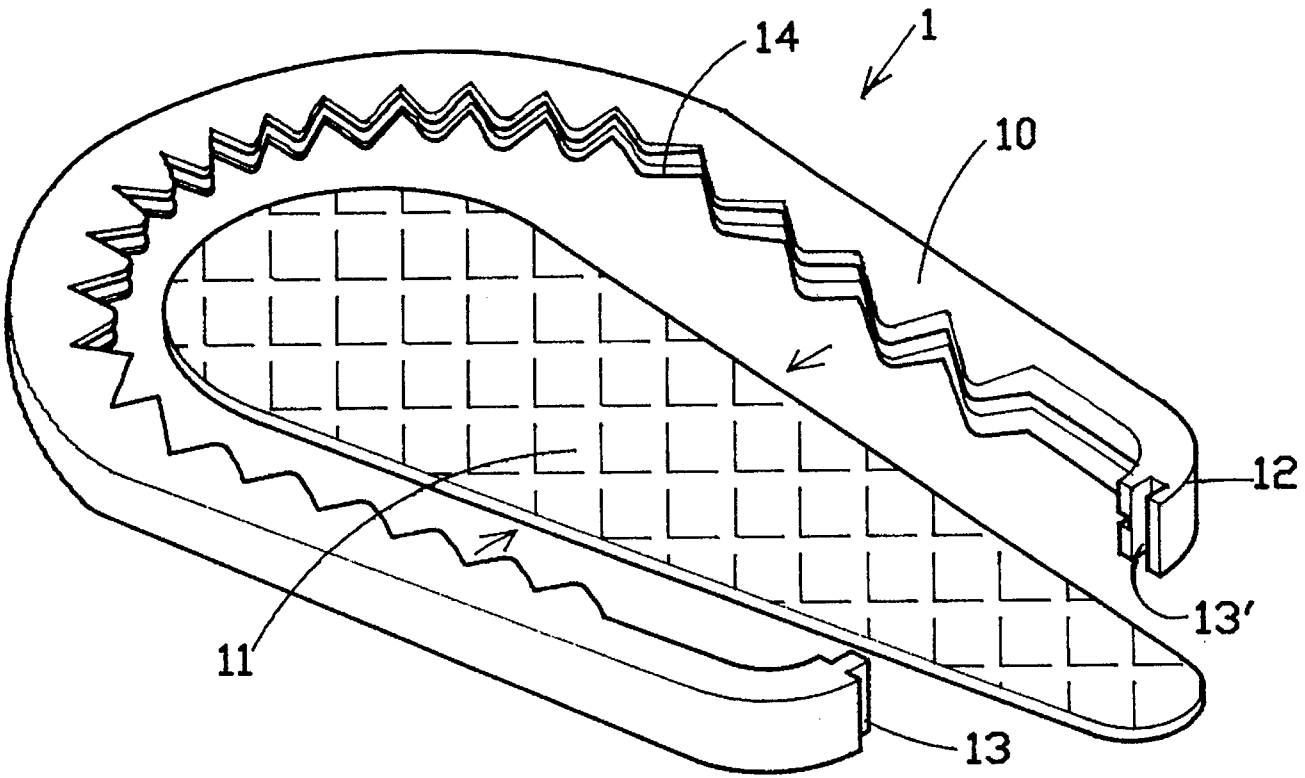
FIG. 2 is an exploded view of the fan blade shown in FIG. 1.

Referring to FIGS. 1 and 2, the fan blade, referenced by 1, is comprised of a frame 10, and a thin flat blade body 11. The blade body can be made from paper, fabric or a metal or wooden sheet. The frame 10 is shaped like an open loop mounted around the blade body 11, having a blade mounting groove 14 at an inner side along the length for mounting the blade body 11, a male coupling portion (for example, a tongue) 13 and a female coupling portion (for example, a groove) 13' at two opposite ends. When the blade body 11 is fitted into the blade mounting groove 14, the male coupling portion 13 and the female coupling portion 13' are connected into a coupling head 12 to hold the blade body 11 inside the frame 10. When the male coupling portion 13 and the female coupling portion 13' are connected into the coupling head 12, they are fixedly secured together by screws. If the frame 10 is made from plastics, an ultrasonic welding process can be employed to fix the male coupling portion 13 and the female coupling portion 13' together. The coupling head 12 is for coupling to the motor shaft. The thickness of the frame 10 gradually reduces from the coupling head 12 so that the fan blade 1 will not be deformed easily. The height of the blade mounting groove 14 is approximately equal to the thickness of the blade body 11, so that the blade body 11 does not vibrate after installation. The border of the inner side of the frame 10 may be serrated so that the frame 10 can be bent into shape and mounted around the blade body 11.

Figure 3:
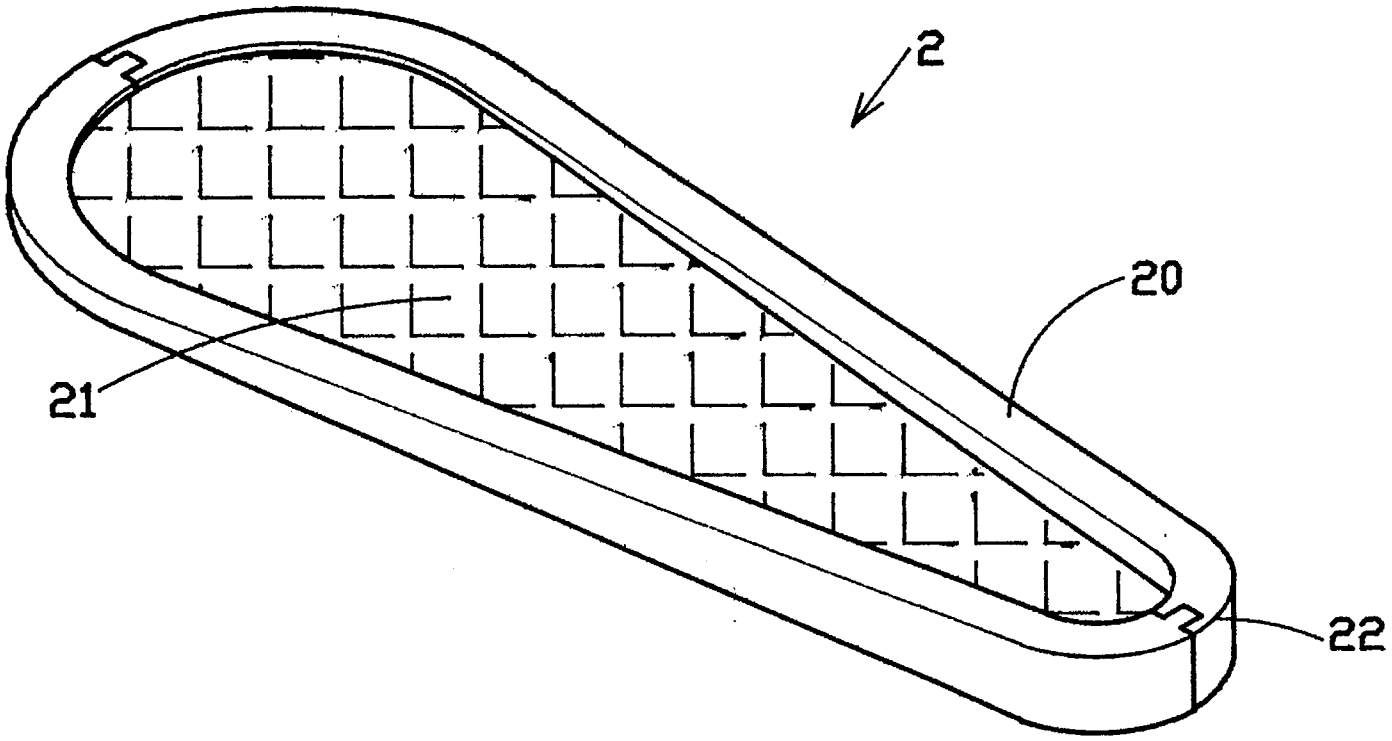
FIG. 3 is an elevational view of a fan blade according to a second embodiment of the present invention.
Figure 4:
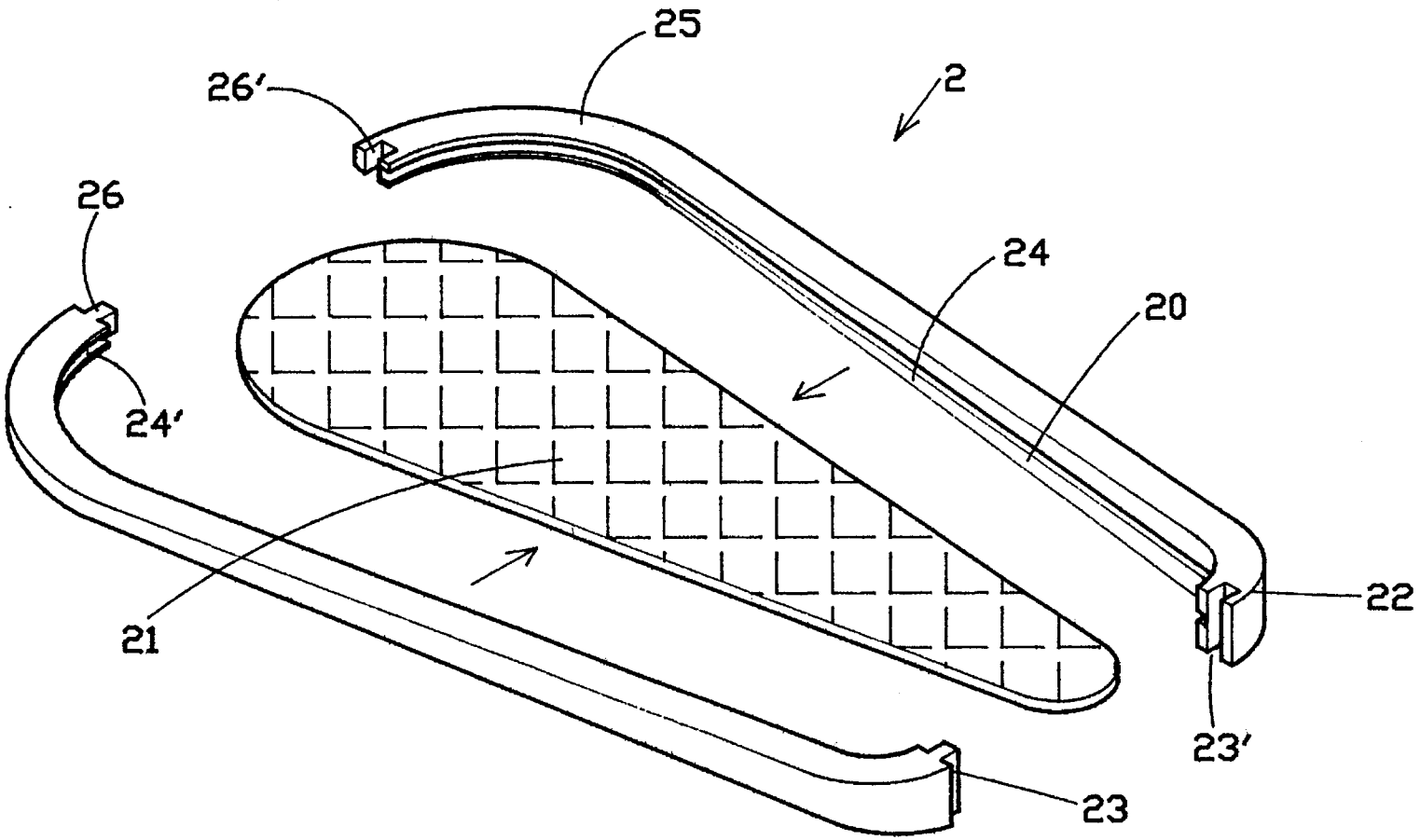
FIG. 4 is an exploded view of the fan blade shown in FIG. 1.

Referring to FIGS. 3 and 4, the fan blade, referenced by 2, is comprised of a frame 20, and a thin flat blade body 21. The frame 20 is mounted around the blade body 21, having a head 22 at one end for coupling to the motor shaft and a tail 25 at an opposite end. The thickness of the frame 20 gradually reduces from the head 22 toward the tail 25. The frame 20 is comprised of two symmetrical parts. One part of the frame 20 has female coupling portions 23' and 26' at two opposite ends, and a longitudinal blade mounting groove 24 at an inner side along the length for mounting the blade body 21. The other part of the frame 20 has male coupling portions 23 and 26 at two opposite ends, and a longitudinal blade mounting groove 24' at an inner side along the length for mounting the blade body 21. By fastening the male coupling portions 23 and 26 to the female coupling portions 23' and 26', the two symmetrical parts of the frame 20 are connected together. When the male coupling portion 23 and the female coupling portion 23' are connected into the head 22, the male coupling portion 23 and the female coupling portion 23' are fixedly secured together by screws or ultrasonic welding. When the male coupling portion 26 and the female coupling portion 26' are connected into the tail 25, the male coupling portion 26 and the female coupling portion 26' are fixedly secured together by screws or ultrasonic welding.

Figure 5:
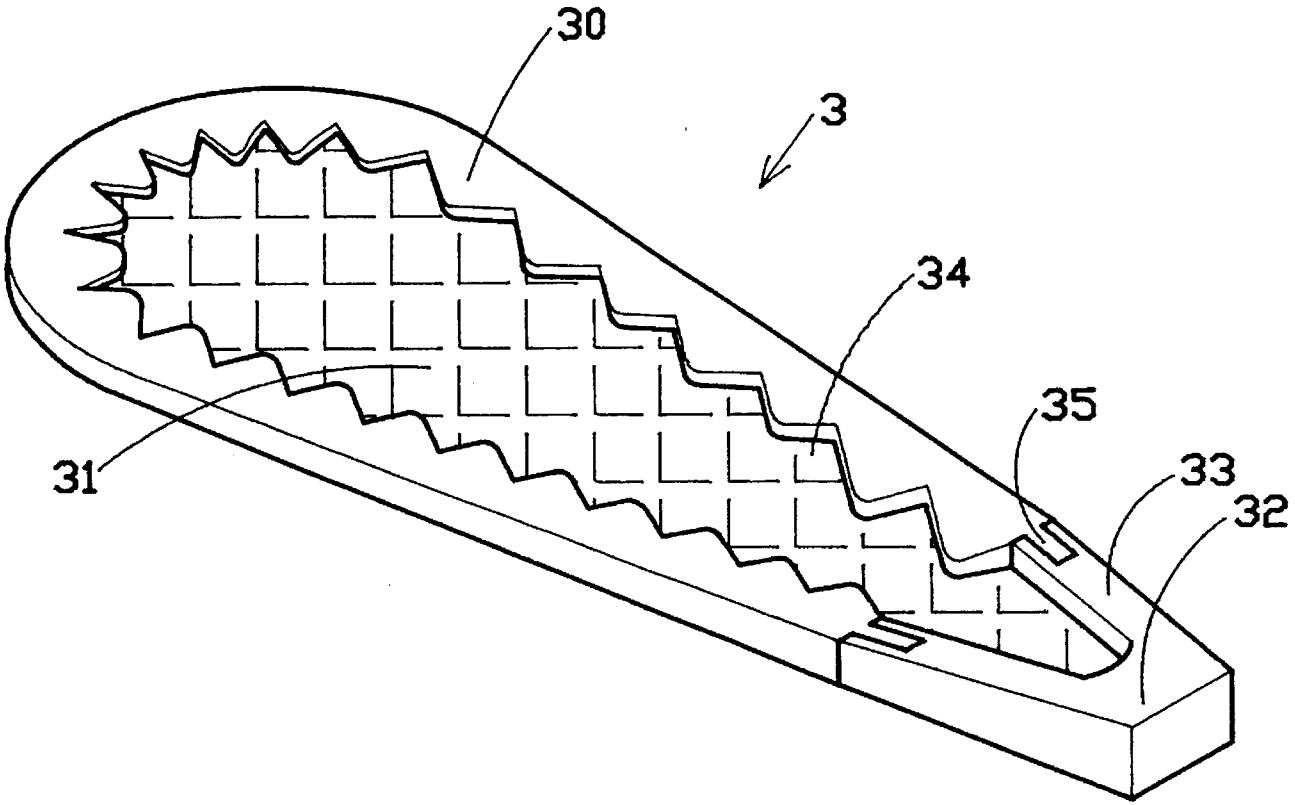
FIG. 5 is an elevational view of a fan blade according to a third embodiment of the present invention.
Figure 6:
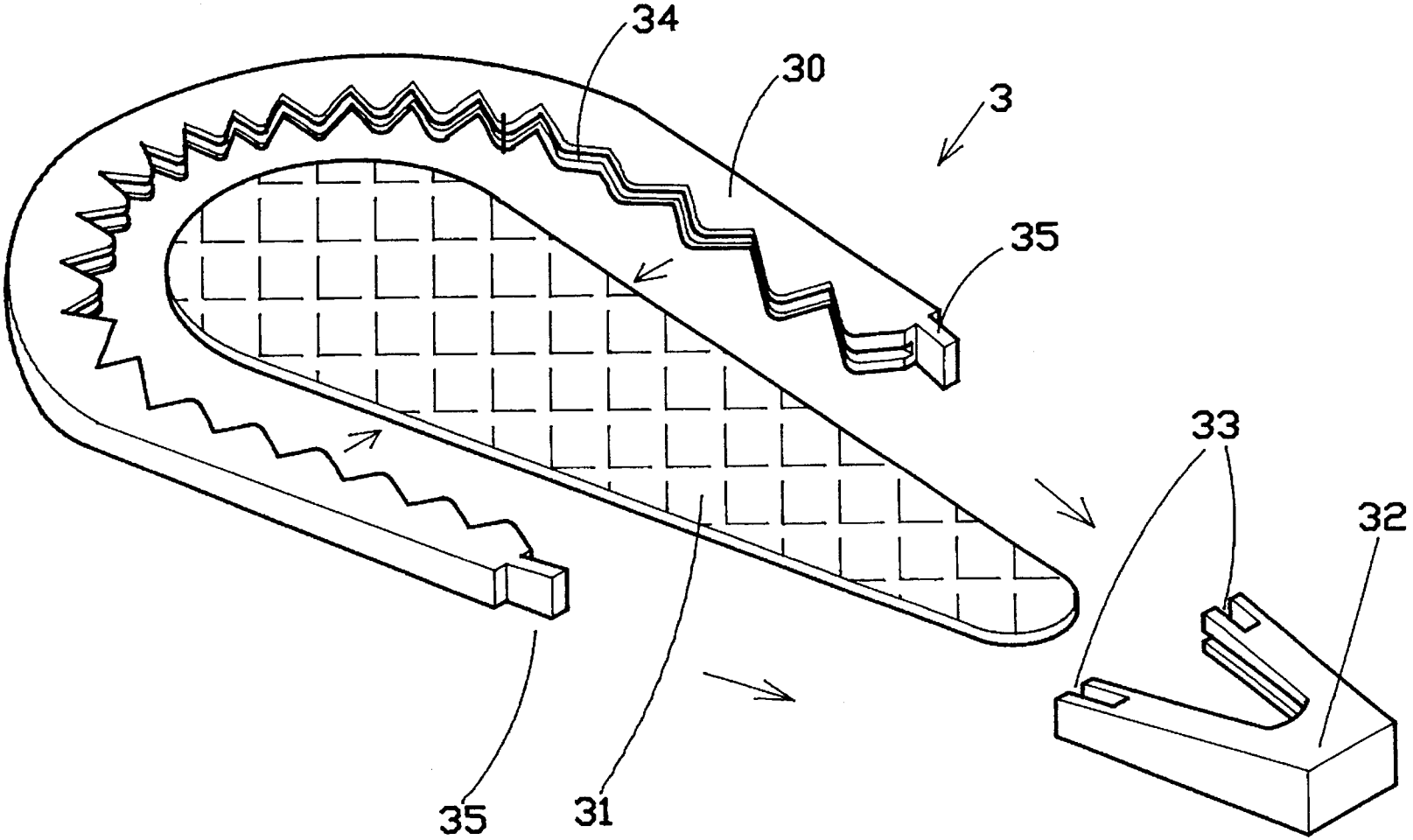
FIG. 6 is an exploded view of the fan blade shown in FIG. 5.

Referring to FIGS. 5 and 6, the fan blade, referenced by 3, is comprised of a blade body 31, and a frame consisting of an arched clamping strip 30 and a mounting block 32 and mounted around the blade body 31. The clamping strip 30 has a blade mounting groove 34 at an inner side along the length for mounting the blade body 31, and two male coupling portions 35 at two opposite ends. The mounting block 32 is for coupling to the motor shaft, having two female coupling portions 33 at two opposite ends respectively fastened to the male coupling portions 35 of the clamping strip 30 to stop the blade body 31 in the blade mounting groove 34.

Figure 7:
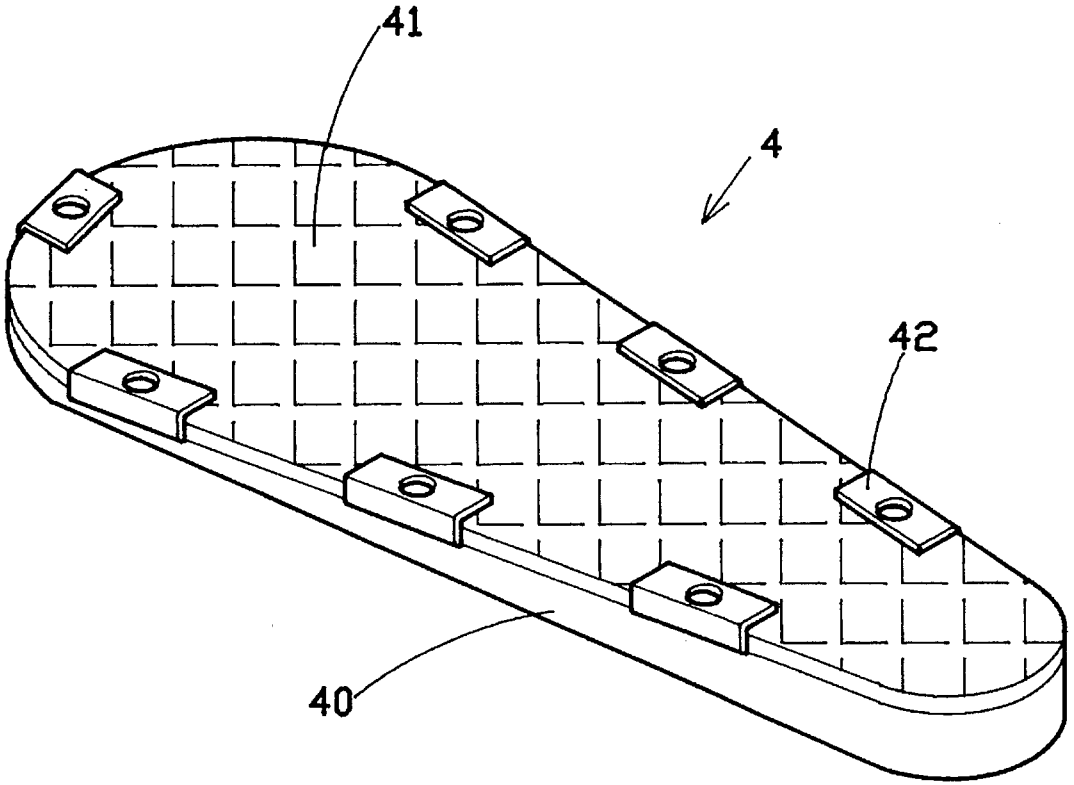
FIG. 7 is an elevational view of a fan blade according to a fourth embodiment of the present invention.
Figure 8:
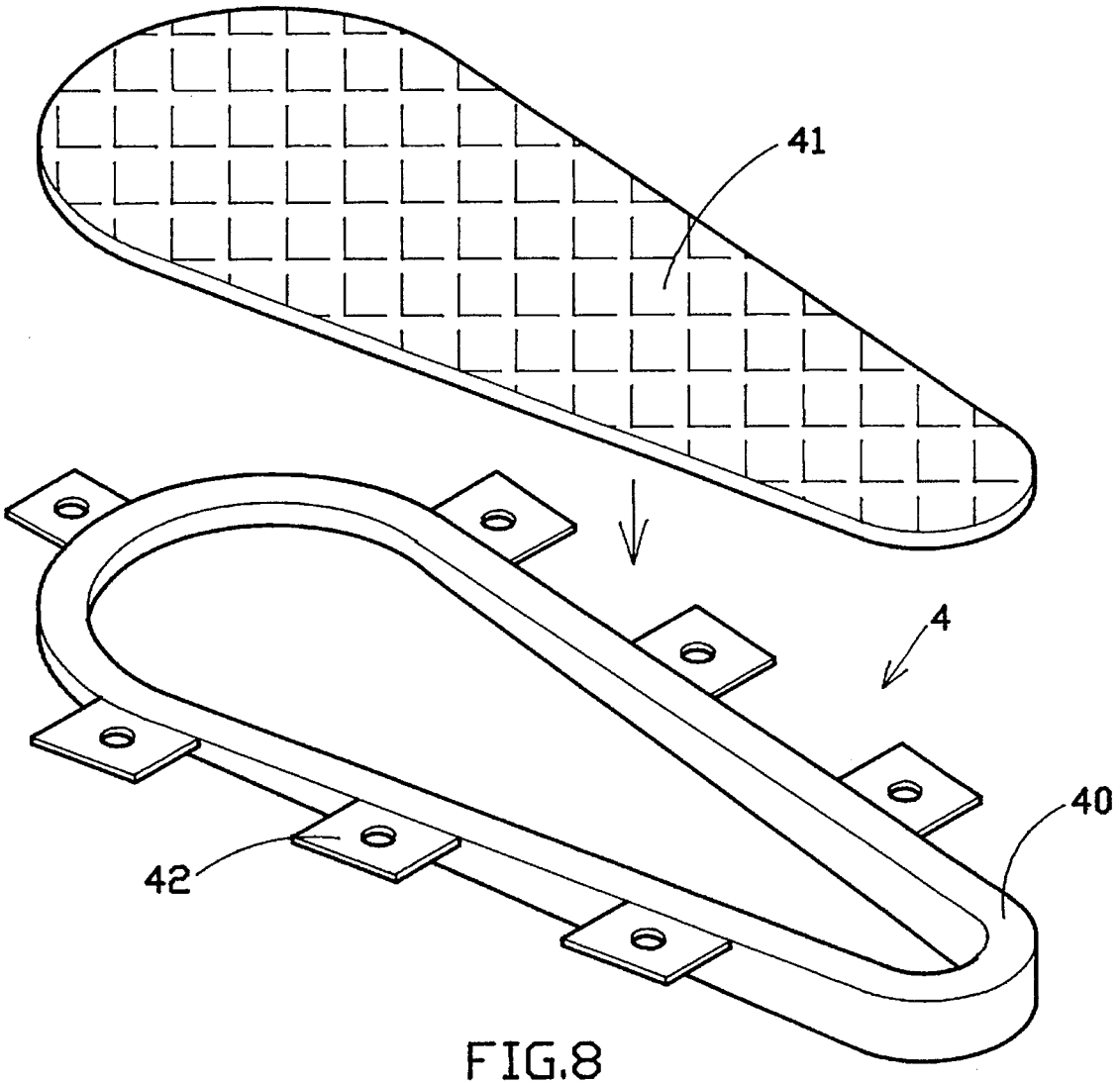
FIG. 8 is an exploded view of the fan blade shown in FIG. 7.

Referring to FIGS. 7 and 8, the fan blade, referenced by 4, is comprised of a frame 40, and a blade body 41 fastened to the frame 40. The frame 40 is an open structure fitting over the blade body, having a plurality of outward clamping lugs 42 spaced around the border of the top side thereof. When the blade body 41 is placed on the top side of the frame 40, the clamping lugs 42 are respectively bent inwards to hold down the blade body 41.

Figure 9:
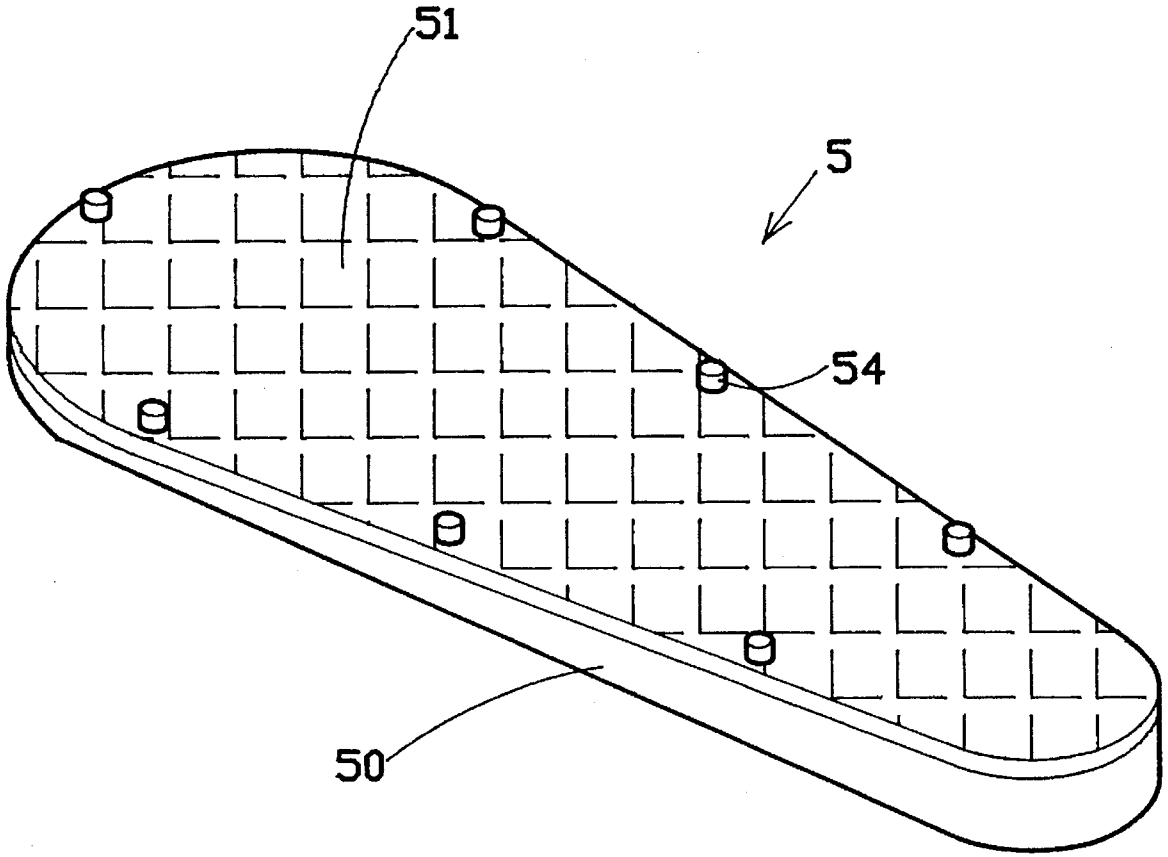
FIG. 9 is an elevational view of a fan blade according to a fifth embodiment of the present invention.
Figure 10:
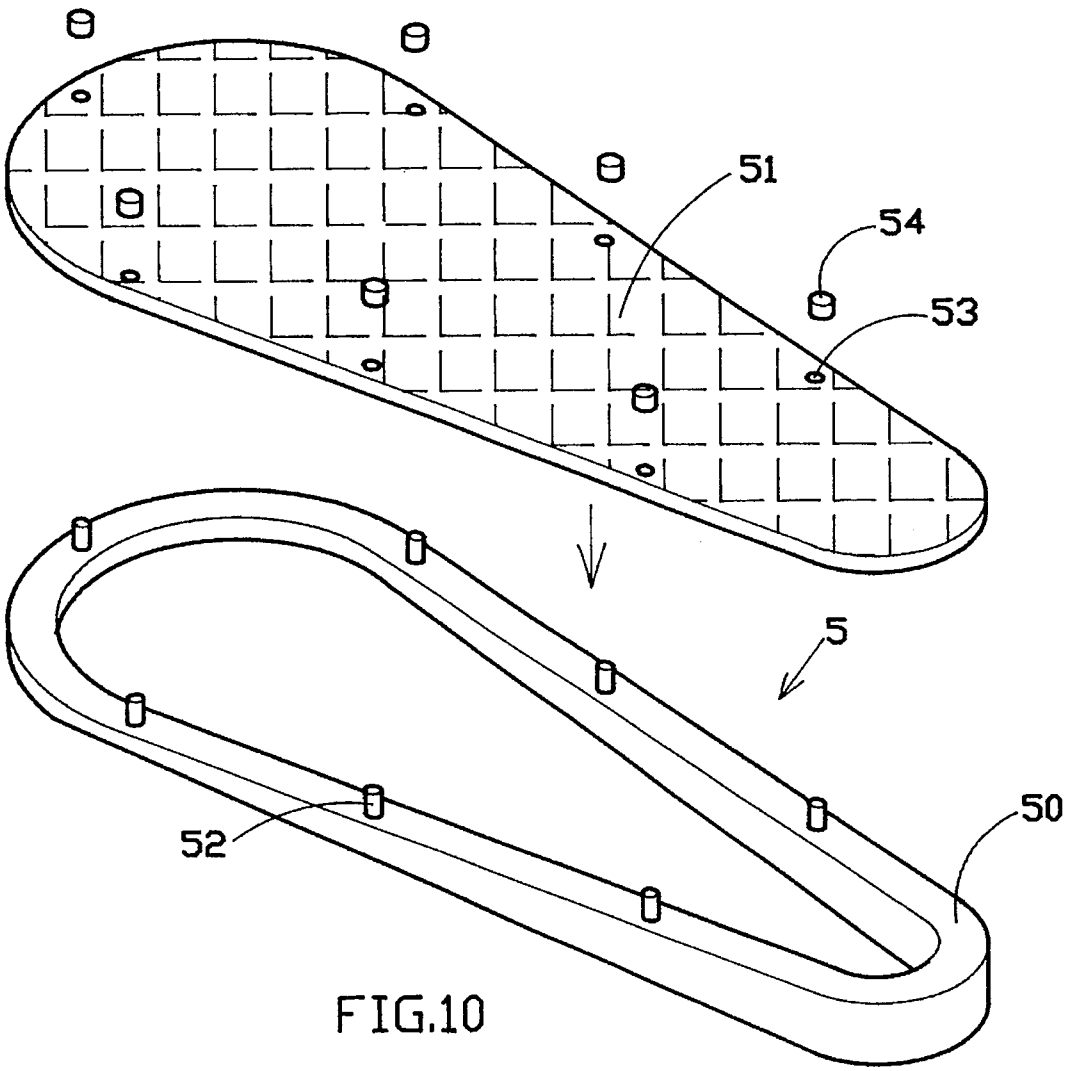
FIG. 10 is an exploded view of the fan blade shown in FIG. 9.

Referring to FIGS. 9 and 10, the fan blade, referenced by 5, is comprised of an open frame 50 and a blade body 51 fastened to the open frame 50 at one side. The open frame 50 has a plurality of upright pins 52 spaced at one side along the border. The blade body 51 has a plurality of pin holes 53 spaced around the border. When the blade body 51 is attached to the frame 50, the upright pins 52 are respectively fitted into the pin holes 53, and respective end caps 54 are respectively fixed to the upright pins 52 to secure the blade body 51 in place.

It is to be understood that the drawings are designed for purposes of illustration only, and are not intended as a definition of the limits and scope of the invention disclosed.

I claim:

1. A fan blade comprising an open frame, and a flat, thin blade body fastened to said open frame, said open frame having a coupling head at one end for coupling to a motor shaft and a tail at an opposite end the thickness of said open frame gradually reducing from said coupling head toward said tail.

2. The fan blade of claim 1 wherein said open frame has a blade mounting groove on the inside for mounting said blade body, and the coupling head of said open frame is formed of two separated coupling portions detachably connected together by a tongue-and-groove joint so that said two separated coupling portions can be separated from each other for permitting said blade body to be fitted into said blade mounting groove.

3. The fan blade of claim 2 wherein said tongue-and-groove joint is further sealed by ultrasonic welding.

4. The fan blade of claim 2 wherein said open frame has a serrated inner side around said blade mounting groove.

5. The fan blade of claim 1 wherein said blade body is made from metal sheet.

6. The fan blade of claim 1 wherein said blade body is made from paper.

7. The fan blade of claim 1 wherein said blade body is made from fabric.

8. The fan blade of claim 1 wherein said blade body is made from wooden sheet.

9. The fan blade of claim 1 wherein said open frame has a blade mounting groove on the inside for mounting said blade body; the coupling head and the tail of said open frame are respectively formed of two separated coupling portions detachably connected together by a respective tongue-and-groove joint so that said two separated coupling portions can be separated from each other for permitting said blade body to be fitted into said blade mounting groove.

10. The fan blade of claim 9 wherein said tongue-and-groove joints are further sealed by ultrasonic welding.

11. The fan blade of claim 1 wherein said open frame is comprised of an arched clamping strip and a mounting block connected together and mounted around said blade body, said clamping strip having two male coupling portions at two opposite ends, said mounting block having two female coupling portions at two opposite ends respectively fastened to the male coupling portions of said clamping strip.

12. The fan blade of claim 1 wherein said open frame has a flat top side, which supports said blade body, and a plurality of clamping lugs spaced around the border of said top side and clamped on said blade body.

13. The fan blade of claim 1 wherein said blade body has a plurality of pin holes spaced around the border; said open frame comprises a plurality of upright pins at one side respectively fitted into the pin holes of said blade body and then fastened with a respective cap.

* * * * *